US009499982B2

(12) United States Patent
Ketzer et al.

(10) Patent No.: US 9,499,982 B2
(45) Date of Patent: Nov. 22, 2016

(54) COATED NON-WOVEN FABRICS FROM INORGANIC FIBERS AND FUNCTIONAL, DECORATIVE LAYERS FOR FLOOR COVERINGS, CEILING COVERINGS AND WALL COVERINGS MANUFACTURED THEREFROM

(71) Applicant: JOHNS MANVILLE, Denver, CO (US)

(72) Inventors: Michael Ketzer, Collenberg (DE); Klaus Friedrich Gleich, Highlands Ranch, CO (US)

(73) Assignee: Johns Manville, Denver, CO (US)

( * ) Notice: Subject to any disclaimer, the term of this patent is extended or adjusted under 35 U.S.C. 154(b) by 165 days.

(21) Appl. No.: 13/907,130

(22) Filed: May 31, 2013

(65) Prior Publication Data

US 2013/0330513 A1 Dec. 12, 2013

(30) Foreign Application Priority Data

Jun. 6, 2012 (DE) ..... 10 2012 011 234

(51) Int. Cl.

| | |
|---|---|
| ***E04C 2/24*** | (2006.01) |
| ***D06N 3/18*** | (2006.01) |
| ***D06N 3/00*** | (2006.01) |

(52) U.S. Cl.

CPC ..... *E04C 2/246* (2013.01); *D06N 3/0022* (2013.01); *D06N 3/0063* (2013.01); *D06N 3/183* (2013.01); *D06N 2209/067* (2013.01); *D06N 2209/1657* (2013.01); *D06N 2211/06* (2013.01); *D06N 2211/063* (2013.01); *D06N 2211/066* (2013.01); *Y10T 428/2481* (2015.01); *Y10T 428/24372* (2015.01); *Y10T 428/24967* (2015.01); *Y10T 442/2008* (2015.04); *Y10T 442/209* (2015.04)

(58) Field of Classification Search

CPC ..... D06N 2209/067; D06N 2209/1657; D06N 2211/06; D06N 2211/063; D06N 2211/066; D06N 3/0022; D06N 3/0063; D06N 3/183; E04C 2/246; Y10T 428/24372; Y10T 248/2481; Y10T 428/24968

USPC ..... 428/196, 215, 219, 404; 442/60, 70, 442/341, 342, 414, 415, 417; 427/356

See application file for complete search history.

(56) References Cited

U.S. PATENT DOCUMENTS

| | | | | |
|---|---|---|---|---|
| 2005/0181693 | A1 | 8/2005 | Kajander | |
| 2006/0178264 | A1* | 8/2006 | Kameshima et al. | 502/439 |
| 2013/0260992 | A1* | 10/2013 | Nahm | 503/201 |

FOREIGN PATENT DOCUMENTS

| | | | | |
|---|---|---|---|---|
| EP | 1 607 215 | A1 | 12/2005 | |
| EP | 2 269 814 | A1 | 1/2011 | |
| WO | WO 00/05311 | * | 2/2000 | C09C 1/00 |
| WO | 01/05588 | A1 | 1/2001 | |

* cited by examiner

*Primary Examiner* — Arti Singh-Pandey

(74) *Attorney, Agent, or Firm* — Robert D. Touslee

(57) ABSTRACT

The present invention relates to a non-woven fabric made of inorganic fibers, which has a coating of at least two layers on one of both surfaces, wherein (i) the non-woven fabric made of inorganic fibers has a thickness of at least 0.2 mm, (ii) the first layer of the coating comprises particles, whose particle size is between 50 and 100 μm, (iii) the second layer of the coating, which is applied onto the first layer, comprises particles, wherein more than 90% of the particles have a particle size of less than 20 μm.

The non-woven fabric made of inorganic fibers according to the invention, in particular glass non-woven fabrics, are in particular suitable for producing decorative coatings for floor coverings, ceiling coverings and wall coverings.

27 Claims, No Drawings

COATED NON-WOVEN FABRICS FROM INORGANIC FIBERS AND FUNCTIONAL, DECORATIVE LAYERS FOR FLOOR COVERINGS, CEILING COVERINGS AND WALL COVERINGS MANUFACTURED THEREFROM

The invention relates to non-woven fabrics from inorganic fibers and functional, in particular glass non-woven fabrics, with a special coating and decorative coatings for floor coverings, ceiling coverings and wall coverings manufactured therefrom.

Decorative coatings within buildings, in particular for public and/or industrial buildings, must be more and more secure with respect to the danger that one can be exposed to through fire. The increased fire protection requirements are known in the technical field due to constantly tightened legal regulations. These increased requirements also more and more include individual components of interior finishings, such as floor coverings, wall coverings and/or ceiling coatings. Such decorative elements, taken alone, are partially to be classified as not safe with respect to the fire protection requirements, or can be realized only with very high expenditure. These fire protection requirements, however, can be fulfilled through use of glass non-woven fabrics, which have decorative layers. It is possible, in particular with glass non-woven fabrics, which are printable and intrinsically have an appropriate fire resistance, to produce wall coverings, floor coverings or ceiling coverings in a very simple and secure manner.

Decorative coatings in the form of planar rolled goods or sheet goods used as non-woven fabrics based on thermoplastic fibers or cellulose fibers with a decorative printing and, if applicable, with additional plastics finishing are generally known. Also, non-woven fabrics with mineral filler materials for gypsum board reinforcements or so-called non-woven wallpapers with mineral coatings, which require additional painting after installation on the wall, are known.

The present invention relates to a non-woven fabric made of inorganic fibers, which has a coating of at least two layers on one of both surfaces, wherein (i) the non-woven fabric made of inorganic fibers has a thickness of at least 0.2 mm, (ii) the first layer of the coating comprises particles, whose particle size is between 50 and 100 μm, (iii) the second layer of the coating, which is applied onto the first layer, comprises particles, wherein more than 90% of the particles have a particle size of less than 20 μm.

The coated non-woven fabrics according to the invention made of inorganic fibers may also have further functional layers, for example antibacterial, antistatic and/or conductive layers.

The coated non-woven fabrics according to the invention made of inorganic fibers, in particular the glass non-woven fabrics, have a weight per unit area of between 50 and 500 g/m$^2$, preferably 100 and 500 g/m$^2$, wherein these values refer to the final product, wherein the coating is at least 25 g/m$^2$ and at most 300 g/m$^2$.

The coated non-woven fabrics according to the invention made of inorganic fibers, in particular the glass non-woven fabrics, have a very smooth surface quality, which, expressed as roughness, is preferably less than 50 μm, particularly preferably less than 45 μm. The roughness is determined with methods known to the person skilled in the art, for example by means of optical and microscopic methods.

Such good surfaces can be printed-on directly without any problems with known printing techniques, such as digital printing, roller printing or screen printing. "Directly" in the sense of the invention means that the surface no longer has to be smoothed with abrasive methods or available unevennesses no longer have to be eliminated through application of appropriate filler materials.

Non-woven Fabric Made of Inorganic Fibers

Due to the minimum thickness of the non-woven fabric made of inorganic fibers, in particular of the glass non-woven fabric, the coated non-woven fabrics according to the invention can, if applicable, very well compensate for available unevennesses on the surface.

The thickness of the non-woven fabric made of inorganic fibers, in particular of the glass non-woven fabric, is at least 0.2 mm and is determined according to DIN EN ISO 9073 T2.

In addition to non-woven fabrics based on glass fibers, non-woven fabrics made of inorganic mineral fibers and ceramic fibers may also be used. These are aluminosilicate fibers, ceramic fibers, dolomite fibers, wollastonite fibers or fibers of vulcanites, preferably basalt fibers, diabase fibers and/or melaphyre fibers, especially basalt fibers. Diabases and melaphyres are designated collectively as paleobasalts and diabase is also often designated as greenstone.

The non-woven fabrics based on mineral fibers may be formed from filaments, that is to say fibers of infinite length or from staple fibers. The average length of the staple fibers in the non-woven fabric of mineral fibers used according to the invention is between 5 and 120 mm, preferably 10 to 90 mm. In a further embodiment of the invention, the non-woven fabric made of mineral fibers contains a mixture of endless fibers and staple fibers.

The average fiber diameter of the mineral fibers is between 5 and 30 μm, preferably between 8 and 24 μm, especially preferably between 8 and 15 μm.

The weight per unit area of the non-woven fabric made of mineral fibers is between 25 and 350 g/m$^2$, preferably 40 and 150 g/m$^2$, wherein these data refer to a fabric with a binder.

The non-woven fabrics based on glass fibers may be formed from filaments, that is to say fibers of infinite length or from staple fibers. The average length of the staple fibers is between 5 and 120 mm, preferably 10 to 90 mm. In a further embodiment of the invention, the non-woven fabric made of glass fibers contains a mixture of endless fibers and staple fibers.

The average diameter of the glass fibers is between 5 and 30 μm, preferably between 8 and 24 μm, especially preferably between 10 and 21 μm.

In addition to the previously cited diameters, so-called glass microfibers can also be used. The preferred average diameter of the glass microfibers is between 0.1 and 5 pm. The microfibers forming the textile surface can also be present in mixtures with other fibers, preferably glass fibers. Moreover, a layer-shaped structure of microfibers and glass fibers is also possible.

The weight per unit area of the non-woven fabric made of glass fibers is between 25 and 350 g/m$^2$, preferably 40 and 150 g/m$^2$, wherein these data refer to a fabric with a binder.

Suitable glass fibers comprise in particular those manufactured from A-glass, E-glass, S-glass, C-glass, T-glass or R-glass.

The non-woven fabrics can be manufactured in accordance with any known method. For glass non-woven fabrics, this is preferably the dry or wet laid method.

The binder content of the non-woven fabric made of inorganic fibers, in particular of the glass non-woven fabric, is 5-30%, preferably 10-20%, wherein this value refers to the total weight of the non-woven fabric with binder.

The non-woven fabrics made of inorganic fibers used according to the invention, in particular the glass non-woven fabrics, can additionally contain reinforcements. Reinforcements serve to enhance the mechanical properties of the non-woven fabrics, in particular the longitudinal and transverse strengths. Possible reinforcements include longitudinal threads or grating structures. Suitable reinforcement materials are glass threads or structures of high-modulus materials, which are applied onto or inserted into the textile fabric during the production of the textile surface.

The non-woven fabrics used according to the invention must have an air permeability as low as possible so that the coating can be applied by means of forceless application methods. Thus, the non-woven fabrics used according to the invention have an air permeability in the range of less than 3000 $l/m^2$ s, preferably less than 1000 $l/m^2$ s. The air permeability is determined in accordance with DIN EN 9237.

The permeability of the textile surface may also, in addition to the adaptation of the air permeability—alternatively or additionally—be optimized by means of hydrophobization of the fiber surface. This is, for example, possible through addition of a hydrophobing agent to the binder. A suitable hydrophobing agent is, for example, "Nuva 2155" as available from the company Clariant.

Binder

The non-woven fabric made of inorganic fibers according to the invention, in particular the glass non-woven fabrics, preferably contain urea binders, melamine binders or acrylate binders. In a further preferred design, the non-woven fabric contains binders based on polyvinyl alcohol. In addition, formaldehyde-free binders are particularly preferred.

Coating

The non-woven fabrics made of inorganic fibers according to the invention, in particular the glass non-woven fabrics, have a coating of at least two layers on one of both surfaces. The coating, which is applied onto the surface of the non-woven fabric, contains different particle sizes and is specially suitable for decorative printing techniques. The coating is selected so that it does not penetrate the non-woven fabric and thereby allows a low weight per unit area of the coating.

The first layer of the coating comprises particles, whose particle size is between 50 and 100 μm, that is to say the D50 value or also the median value is in the above-mentioned range. The particles may also be platelet-shaped, wherein particles with an aspect ratio of more than 100:1 are particularly preferred. This first layer of the coating may also comprise mixtures of both particle types. In a further preferred variant, the particles have an irregular form and are made of diatomaceous earth (kieselguhr).

The aspect ratio designates the ratio of the depth resp. height of a structure to its (smallest) lateral expansion.

The first layer of the coating preferably has a thickness of between 100 and 1000 μm, preferably 150 and 500 μm.

The second layer of the coating, which is applied onto the first layer, comprises particles, whose particle size is less than 20 μm, i.e. the D90 value is in the above-mentioned range.

In a particularly preferred embodiment of the invention, the D90 value of the particles of the second layer is less than 20 μm.

The second layer of the coating preferably has a thickness, which is 10%-40%, preferably 10%-20% of the overall thickness of the coating consisting of the first and second coatings.

Particularly preferably, the D50 value resp. the D90 value of the particles in the respective layer is not greater than 50% of the thickness of the corresponding layer, preferably not greater than 33% of the thickness of the corresponding layer, in particular not greater than 25% of the thickness of the corresponding layer.

The surfaces obtained by means of the coating according to the invention distinguish themselves through a very smooth and even surface. The roughness is preferably less than 50 μm, particularly preferably less than 45 μm. The roughness is determined with methods known to the person skilled in the art.

If a particular good surface quality is to be obtained, an additional, third layer is applied onto the second layer of the coating. The latter comprises particles, whose particle size is between 2 and 10 μm, that is to say the D50 value or also the median value is in the above-mentioned range. In a particularly preferred embodiment of the invention, the D90 value of the particles of the third layer is between 2 and 10 μm.

In a particular embodiment, the D90 value of the particles of the second layer is less than 20 μm and the D90 value of the particles of the third layer is between 2 and 10 μm.

The particles according to the invention are selected from materials which fulfill the criteria for A2 or SBI B S1 DO in the subsequent fire test.

The individual layers of the coating are applied in the form of suspensions, for example by means of doctor blade or curtain coating methods. The applied quantity may be adjusted by means of a doctor blade or the solid body content of the suspension for the curtain coating method. Such application methods are called forceless application methods. Further forceless application methods in the sense of the present invention are such for which no increased pressure with reference to the ambient pressure acts on the side of the non-woven fabric to be coated, for example through rollers.

The usual known non-woven coatings are realized by means of coating (forced application work or roller impregnation), i.e. the filler materials are pressed through acting forces, for instance outer pressure, into the non-woven fabric. However, fibers thereby still project from the surface. At least, the fibers telescope clearly and the surfaces are therefore suitable for printing.

The coatings according to the invention create the required conditions for the non-woven fabrics to fulfill the graphic printing requirements with respect to color value and color location.

The coatings according to the invention, in particular the particles, penetrate only partially into the non-woven fabric. The particle size of the first layer of the coating is selected in a such a way that the non-woven fabric pores are closed. Such a surface is, however, too rough, similarly to an "orange skin", and is therefore suitable for direct printing. The second, as well as possibly available further layer(s) effect(s) a surface, which may be printed directly.

The dispersions used for producing the individual layers of the coating contain, in addition to said particles, chemical binders, e.g. acrylate binders, as well as, if necessary, particle-like functional materials. The chemical binder are preferably, with respect to their rheology, e.g. viscosity, adjusted resp. selected in such a manner that they do not penetrate or penetrate only a bit into the non-woven fabric.

The portion of the binders used for preparing the individual layers of the coating is 10-40% by weight, preferably 20-30% by weight of the whole coating, wherein these values refer to the dry mass of the coating.

The particles used according to the invention for coating are preferably inorganic particles, preferably calcium carbonates, calcined clay, titanium dioxide, chalk, color pigments, diatomaceous earth or mixtures of the same.

Particularly preferably, the outer layer of the coating contains at least 5% by weight, preferably at least 10% by weight of titanium dioxide.

The possibly available particle-like functional materials usually have the same particle size as the other particles. The functional materials are preferably materials for increasing the fire resistance (flame retardants), materials for conducting away electrostatic charges, materials for sheathing electromagnetic beams, organic or inorganic pigments, in particular color pigments.

The flame retardants are inorganic flame retardants, organophosphorus flame retardants, nitrogen-based flame retardants or intumescence flame retardants. Halogenated (brominated and chlorinated) flame retardants can also be used but are less preferred on account of their risk evaluation. Examples for such halogenated flame retardants are polybrominated diphenyl ethers, e.g., decaBDE, tetrabromobisphenol A and HBCD (hexabromocyclododecane).

Nitrogen-based flame retardants are melamines and ureas.

The organophosphorus flame retardants are typically aromatic and alkyl-esters of the phosphoric acid. TCEP (tris (chloroethyl) phosphate), TCPP (tris(chloropropyl) phosphate), TDCPP (tris(dichloroisopropyl) phosphate), triphenyl phosphate, trioctyl phosphate (tris-(2-ethylhexyl) phosphate) are preferably used.

The inorganic flame retardants are typically hydroxides, such as aluminium hydroxide and magnesium hydroxide, borates, such as zinc borate, ammonium compounds, such as ammonium sulfate, red phosphorus, antimony oxides, such as antimony trioxide and antimony pentoxide or vermiculites.

Antistatic and electromagnetic shielding effects can be achieved by using agents for increasing the electrical conductivity.

These antistatic agents are customarily particles that are electrically conductive. Suitable materials are electrically conductive carbons, such as carbon black, graphite and carbon nanotubes (C nanotubes) or conductive plastics.

The materials for shielding electromagnetic radiation are usually electrically conductive materials.

The inorganic or organic pigments are particle-like materials, in particular pigments, which can also be used in paints.

Use

The non-woven fabrics made of inorganic fibers coated according to the invention, in particular the glass non-woven fabrics, are preferably smooth, even and lightweight. Such layers can be decorated and printed with digital printing, as well as directly with roller printing (very smooth surfaces) resp. screen printing.

The non-woven fabrics made of inorganic fibers coated according to the invention, in particular the glass non-woven fabrics, can also be used for floor coverings, e.g. PVC, cushion vinyl or the like.

The non-woven fabrics made of inorganic fibers coated according to the invention, in particular the glass non-woven fabrics, can be fitted with a decor and used as wall covering, e.g. wallpaper. Such decorative layers can conventionally be installed with paste on conventional walls. If necessary, such decorative layers are also "pre-glued" in order to allow easier installations on the wall.

The non-woven fabrics made of inorganic fibers coated according to the invention, in particular the glass non-woven fabric, may be applied through calandering, hot pressing or double-band pressing onto thermoplastic base supports like PU, PVC, PO.

According to the final application, further additional protective layers may be applied. Alternatively, other carriers like glass wool boards, cork boards, gypsum board etc. can also be decorated. For floor coverings, antislip particles, e.g. of corundum, may also be applied.

In contrast to papers, the non-woven fabrics made of inorganic fibers coated according to the invention, in particular the glass non-woven fabrics, have a clearly higher dimensional stability.

Due to the binders present in the coating, the non-woven fabric made of inorganic fibers coated according to the invention, in particular the glass non-woven fabrics, have surprisingly good resp. excellent draping properties and is not brittle such as conventional glass non-woven fabrics.

Therefore, the non-woven fabrics made of inorganic fibers coated according to the invention, in particular the glass non-woven fabrics, are also suitable for elastic floor applications such as, cushion vinyl or polyolefins or polyurethane (PU) as well as decorative ceiling boards consisting of wood boards, EW boards (engineered wood) or mineral fibers or plastic boards.

The invention claimed is:

1. A non-woven fabric made of inorganic fibers, which has a coating of at least two layers on one of both surfaces, wherein (i) the non-woven fabric made of inorganic fibers has a thickness of at least 0.2 mm, wherein the non-woven fabric fulfills the criteria for A2 or SBI B S1 D0 in a fire test, (ii) the first layer of the coating comprises a plurality of first particles and a plurality of second particles, wherein:

the first particles have an aspect ratio of more than 100:1, the first particles are platelet-shaped, the second particles have a median particle size between 50 and 100 μm, the first particles comprise calcined clay, and the second particles comprise calcined clay, and (iii) the second layer of the coating, which is applied onto the first layer, comprises a plurality of third particles, wherein more than 90% of the third particles have a particle size of less than 20 μm.

2. The non-woven fabric according to claim 1, wherein the coated non-woven fabric made of inorganic fibers has a weight per unit area of between 100 and 500 g/m$^2$, wherein these values refer to the final product, and wherein the coating is at least 25 g/m$^2$ and at most 300 g/m$^2$.

3. The non-woven fabric according to claim 1, wherein the weight per unit area of the non-woven fabric made of mineral fibers is between 40 and 150 g/m$^2$, wherein these data refer to a non-woven fabric with a binder.

4. The non-woven fabric according to claim 1, wherein the inorganic fibers have an average diameter of between 5 and 30 μm.

5. The non-woven fabric according to claim 1, wherein the non-woven fabric made of inorganic fibers, in particular of the glass non-woven fabric, is between 10 and 20%, wherein this value refers to the total weight of the non-woven fabric with binder.

6. The non-woven fabric according to claim 1, wherein the non-woven fabric made of inorganic fibers has a reinforcement, which increases the longitudinal and transverse strengths.

7. The non-woven fabric according to claim 1, wherein the non-woven fabric made of inorganic fibers has an air permeability in the range of less than 10001/$m^2$ s prior to coating.

8. The non-woven fabric according to claim 1, wherein the coated non-woven fabric made of inorganic fibers also has antibacterial, antistatic and/or conductive layers.

9. The non-woven fabric according to claim 1, wherein the coated non-woven fabric made of inorganic fibers roughness less than 45 μm.

10. The non-woven fabric according to claim 1, wherein the first layer of the coating has a thickness of between 150 and 500 μm.

11. The non-woven fabric according to claim 1, wherein the second layer of the coating has a thickness, which is 10%-20%, of the overall thickness of the coating.

12. The non-woven fabric according to claim 1, wherein an additional, third layer is applied onto the second layer of the coating, wherein this layer comprises a plurality of fourth particles, wherein the fourth particles have a particle size D50 between 2 and 10 μm.

13. The non-woven fabric according to claim 1, wherein the coating was applied by means of forceless application methods.

14. The non-woven fabric according to claim 1, wherein the third particles comprise calcium carbonates, calcined clay, titanium dioxide, chalk, color pigments, diatomaceous earth or mixtures of the same.

15. The non-woven fabric according to claim 1, wherein the outer layer of the coating has at least 10% by weight of titanium dioxide.

16. The non-woven fabric according to claim 1, wherein the coating comprises chemical binders, wherein the portion of binders in the individual layer is between 20-30% by weight, wherein these values refer to the dry mass of the coating.

17. Printed surfaces containing a printed non-woven fabric wherein the non-woven fabric is defined as in any one of the preceding claims.

18. A printed surface according to claim 17, wherein the surface is a floor covering, wall covering or ceiling covering.

19. A printed surface according to claim 18, wherein the surface is a floor covering comprising PVC or cushion vinyl.

20. A printed surface according to claim 18, wherein the surface is a ceiling covering comprising wood board, engineered wood board, mineral fibers, or plastic boards.

21. A printed surface according to claim 17, wherein the surface is a floor covering or ceiling covering, which has an adhesive layer, preferably an adhesive layer, which can be activated with water.

22. A printed surface according to claim 17, wherein the surface has an additional thermoplastic base support or another carrier selected from the group consisting of glass wool boards, cork boards or gypsum boards.

23. A printed surface according to claim 17, wherein the non-woven fabric is directly printed by digital printing or roller printing.

24. The non-woven fabric according to claim 1, wherein the non-woven fabric is made of fibers selected from the group consisting of aluminosilicate fibers, ceramic fibers, dolomite fibers, wollastonite fibers, fibers of vulcanites, and basalt fibers.

25. The non-woven fabric according to claim 1, wherein the plurality of second particles have an irregular form.

26. The non-woven fabric according to claim 1, wherein the plurality of third particles have a particle size D90 that is not greater than 25% of the thickness of the second layer.

27. The non-woven fabric according to claim 1, wherein the first layer consists of the plurality of first particles, the plurality of second particles, and a binder.

* * * * *